US010724247B2

(12) United States Patent
Knapp

(10) Patent No.: US 10,724,247 B2
(45) Date of Patent: Jul. 28, 2020

(54) DEVICE FOR SECURING A GLASS PANE

(71) Applicant: Knapp GmbH, Euratsfeld (AT)

(72) Inventor: Friedrich Knapp, Bad Kreuzen (AT)

(73) Assignee: KNAPP GMBH, Euratsfeld (AT)

( * ) Notice: Subject to any disclaimer, the term of this patent is extended or adjusted under 35 U.S.C. 154(b) by 0 days.

(21) Appl. No.: 16/321,841

(22) PCT Filed: Jul. 17, 2017

(86) PCT No.: PCT/EP2017/068009
§ 371 (c)(1),
(2) Date: Jan. 30, 2019

(87) PCT Pub. No.: WO2018/024473
PCT Pub. Date: Feb. 8, 2018

(65) Prior Publication Data

US 2019/0177982 A1 Jun. 13, 2019

(30) Foreign Application Priority Data

Aug. 4, 2016 (EP) ..... 16182839

(51) Int. Cl.
*E04F 13/07* (2006.01)
*E04F 13/08* (2006.01)
(Continued)

(52) U.S. Cl.
CPC ..... *E04F 13/0828* (2013.01); *E04F 13/083* (2013.01); *E04F 13/0821* (2013.01);
(Continued)

(58) Field of Classification Search
CPC ..... E06B 3/54; E06B 3/5427; E04B 2/885; E04F 19/062; E04F 13/145; E04F 13/0808; E04F 13/0889
See application file for complete search history.

(56) References Cited

U.S. PATENT DOCUMENTS 4,307,551 A * 12/1981 Crandell ..... E04F 13/0808 52/204.591
4,483,122 A * 11/1984 Crandell ..... E04F 13/0889 52/235
(Continued)

FOREIGN PATENT DOCUMENTS

DE 102010056194 A1 6/2012

OTHER PUBLICATIONS

English Translation of International Preliminary Report on Patentability in corresponding International Application No. PCT/EP2017/068009.
(Continued)

*Primary Examiner* — Gisele D Ford
(74) *Attorney, Agent, or Firm* — Hoffmann and Baron, LLP

(57) ABSTRACT

The disclosed subject matter relates to an apparatus for detachable fastening of a glass pane to a substructure, comprising a block strip that is subdivided into a block piece to block the glass pane on one of its peripheral sides and a holding piece to lie against the substructure, the block strip having at least one opening for fastening means for detachable fastening of the block strip to the substructure, and a bonding strip, an outer surface of which is bondable with one side of the glass pane, wherein the holding piece has a projection and the bonding strip engages the projection on the side facing away from the block piece when the glass pane is in the fastened state.

10 Claims, 3 Drawing Sheets

(51) Int. Cl.
*E04F 13/14* (2006.01)
*E06B 3/54* (2006.01)
*E04B 2/88* (2006.01)

(52) U.S. Cl.
CPC ..... *E04F 13/145* (2013.01); *E06B 3/54* (2013.01); *E06B 3/5427* (2013.01); *E04B 2/885* (2013.01)

(56) References Cited

U.S. PATENT DOCUMENTS 4,625,481 A 12/1986 Crandell
4,650,702 A * 3/1987 Whitmyer ..... E06B 3/5427 428/31
4,768,321 A * 9/1988 Crandell ..... E04F 13/0808 52/235
4,803,817 A 2/1989 White et al.
4,905,435 A * 3/1990 Horst ..... B32B 17/10293 52/235
5,014,477 A * 5/1991 MacDonald ..... E04B 2/967 52/204.593
5,076,034 A * 12/1991 Bandy ..... E04B 2/967 52/204.591
5,083,405 A * 1/1992 Miller ..... E04B 1/7612 52/204.591
5,199,236 A * 4/1993 Allen ..... E04C 2/54 52/204.591
5,212,922 A * 5/1993 Werner ..... E04B 2/967 52/208
5,301,484 A * 4/1994 Jansson ..... E04F 13/145 52/122.1
5,355,645 A * 10/1994 Farag ..... E04B 2/96 52/235
5,381,637 A * 1/1995 Farag ..... E06B 3/5427 52/204.593
5,592,795 A * 1/1997 Rinehart ..... E04B 2/967 52/204.591
5,694,722 A * 12/1997 Husting ..... A47K 3/30 296/96.21
6,269,601 B1 * 8/2001 Kenny ..... E06B 3/5427 428/192
8,468,765 B1 * 6/2013 Kim ..... E04F 13/0835 52/235
10,526,791 B2 * 1/2020 Loyd ..... E04B 2/90
2002/0124499 A1 * 9/2002 Braybrook ..... E04B 2/96 52/235
2009/0241451 A1 * 10/2009 Griffiths ..... E04F 13/081 52/309.4
2009/0241456 A1 * 10/2009 Griffiths ..... E04F 13/0825 52/506.08
2010/0122503 A1 * 5/2010 Davies ..... B32B 5/12 52/309.1
2012/0151859 A1 * 6/2012 Cullen ..... E04B 1/0007 52/309.4
2013/0186027 A1 7/2013 Sharpe et al.
2014/0026502 A1 * 1/2014 Carbary ..... E04B 2/90 52/235
2019/0100913 A1 * 4/2019 Doyon ..... E06B 3/5427

OTHER PUBLICATIONS

International Search Report dated Nov. 9, 2017 from corresponding International Application No. PCT/EP2017/068009.

* cited by examiner

DEVICE FOR SECURING A GLASS PANE

CROSS-REFERENCE TO RELATED APPLICATIONS

This application is a National Phase application of International Application No. PCT/EP2017/068009 filed Jul. 17, 2017 which claims priority to the European Patent Application No. 16182839.7 filed Aug. 4, 2016, the disclosures of which are incorporated herein by reference.

TECHNICAL FIELD

This disclosed subject matter relates to an apparatus for detachable fastening of a glass pane to a substructure.

BACKGROUND

In conventional windows, the glass pane—which today is usually laminated insulating glass—is generally fastened in a frame. The frame lies around the periphery of the glass pane in the plane of the glass pane, and the glass pane is fixed ("blocked") in the frame with blocks pushed in between the frame and the peripheral sides of the glass pane. To ensure that the fixation is as free of force as possible, the load-bearing blocks ("supporting blocks") in the case of vertical glass are usually made of rigid plastic or hardwood, and the blocks that have less load on them ("spacer blocks") are made of a softer elastic material.

When glass panes are used for glazing on façades, e.g., double façades or element façades, or in the interior, e.g., for inner walls or elevator shafts, the fastening usually has to be as inconspicuous as possible, almost invisible, for which reason a frame construction such as is used for windows is unsuitable. Instead, today the glass panes for glass façades, glass sidings, and even glass rotating elements and glass sliding elements are usually fastened to a substructure lying behind the plane of the glass pane, e.g., in mullion/transom construction. Remaining narrow joints between the individual glass panes are provided either with joint sealant or with cover moldings. In order to be able to replace the individual glass panes separately, the fastening must be detachable.

On the one hand, the glass pane can be fastened to the substructure using point mounts with bolts that pass through the glass pane, e.g., at the corners. Such point mounts leave especially narrow joints between adjacent glass panes, since the joints can be designed merely as expansion joints, however require an elastic connection between the bolt and the hole in order, e.g., to compensate for the thermal expansion of the glass pane. Furthermore, the glass panes must have holes drilled through them, structurally weakening them precisely at the points of highest load—the fastening points.

On the other hand, line mounts are used, which involve clamping every glass pane against the substructure, e.g., by cover moldings that are screwed through the joints to the substructure and that simultaneously come in contact with the outside edge of the glass pane. However, especially in the case of large glass panes, this clamping requires large forces, and thus solid cover moldings that are clearly visible from outside. This also puts the glass panes under high stress.

Alternatively, every glass pane can also be borne by rest strips that protrude from the substructure and can optionally be blocked between them, fixation of the glass pane to the substructure additionally requiring cover moldings that are screwed against the rest strips and that come in contact with the outside edge of the glass pane. In this variant, the glass panes are mounted largely free of stress, however wider joints and also outside cover moldings are required, limiting the design freedom for the glass façade.

BRIEF SUMMARY

The disclosed subject matter has the goal of creating an apparatus for detachable fastening of a glass pane to a substructure, which apparatus holds the glass pane under as little stress as possible in a detachable and nevertheless secure manner, and allows this to be done quickly.

This goal is achieved by an apparatus that is characterized by:

a block strip that is subdivided into a block piece to block the glass pane on one of its peripheral sides and a holding piece to lie against the substructure, the block strip having at least one opening for fastening means for detachable fastening of the block strip to the substructure, and a bonding strip, an outer surface of which is bondable to one side of the glass pane, wherein the holding piece has a projection and the bonding strip engages the projection on the side facing away from the block piece when the glass pane is in the fastened state.

The block strip that can be fastened directly to the substructure and that has a block piece on which the peripheral side of the glass pane lies, does away with the need for additional blocking and allows a narrower joint between adjacent glass panes. When the glass pane is in its fastened state, it is securely held in the direction of the substructure because the projection is engaged, without this requiring a cover molding coming in contact with the outer surface of the glass pane. Just as it is possible to do without a cover molding, it is also possible to do without drilling holes through the glass pane, so that the design freedom is also preserved on a glazing with multiple glass panes. The block strips can be used on all peripheral sides of the glass pane, and every glass pane can be individually detached from the substructure after removal of all block strips that engage with the bonding strips bonded to this glass pane. Every block strip can block glass panes on both sides of that joint lying between them in which the block strip is arranged, or only that glass pane that the block strip also holds with the help of the bonding strip bonded to this glass pane.

In a further embodiment, the bonding strip has a groove delimited by two legs, into which groove said projection engages when the glass pane is in the fastened state, causing the one leg to engage the projection on the side facing away from the block piece, the other leg being bondable to the glass pane on said outer surface. In this embodiment, the groove in the bonding strip and the projection on the holding piece interact to hold the glass pane securely in the direction of the substructure. The engagement of the projection into the groove and the possibility of areal bonding of the outer surface of the mentioned other leg with the glass pane exposes the bonding strip and thus its bonding to stress mainly in the direction of the substructure; this largely avoids an additional moment of tilt as a consequence of stress on one side of the bonding strip, which is harmful for the bonding. Moreover, the bonding strip can be bonded to the glass pane flush with its peripheral side, so that it does not project beyond its periphery, which minimizes the danger of damage of a glass pane prefabricated with bonding strips during storage and transport.

It is advantageous for the groove to have at least one undercut and the projection to have a rib complementary to this undercut. This allows the block strip and the bonding strip to be connected with one another already before the glass pane is fastened to the substructure, by pushing the projection into the groove in the longitudinal direction of the block strip and bonding strip. This facilitates the fastening to and detachment from the substructure, since it prevents individual parts from falling off.

According to an advantageous variant of the apparatus, the block strip is made in a single piece. In this way, it is simple to produce the block strip, e.g., by milling, die casting or injection molding, extrusion, or similar processes. Depending on the manufacturing process, the block strip can be homogeneous or can have different materials or strengths over its cross section.

Optionally, the block piece and the holding piece are made of different materials. The holding piece can be very sturdy, e.g., made of hardwood, a rigid (optionally fiber-reinforced) plastic, or aluminum or another metal, and the block piece for blocking the glass pane in a gentle way can be made of a softer, elastic material, e.g., wood, plastic, or rubber. This produces a fastening that is stable and has small dimensions, while being gentle to the glass pane, especially its peripheral sides.

It is especially favorable if the mentioned outer surface of the bonding strip has a shoulder. The bonding of the bonding strip with the glass pane serves not merely to receive forces in the direction of the substructure, but rather the bonding must also be suitable to receive forces in all other directions, e.g., shearing forces as a consequence of the thermal expansion of the glass pane. This is facilitated by a certain minimum thickness of the bonding joint; on the other hand, if too large a thickness of the bonding joint is selected, then the stability and durability of the bonding suffer. Such a shoulder makes it possible to define a bonding joint thickness that is necessary for durable bonding, so that the bonding strip can be securely bonded with the glass pane without other auxiliary means.

Optionally, the block strip has, passing through it in the direction toward the bonding strip, at least one further opening for insertion of a retaining pin, bolt, or something similar, projecting into the bonding strip. This prevents displacement of the block strip and bonding strip with respect to one another, which can lead to an undesired load distribution. If, for example, a screw is used as a retaining pin or if it is used in connection with the mentioned undercut in the groove and the rib on the projection, the block strip for connection with the substructure can be locked in all directions to the bonding strip and thus the glass pane.

The block strip can be made so that it is especially slender and economizes on materials if the block piece has an L-shaped cross section, one leg of the L bordering the holding piece and the other leg of the L facing said peripheral side of the glass pane during blocking.

In an advantageous embodiment, the block piece has, on its side opposite the holding piece, at least one latching projection for latching of a fall prevention device that overlaps the edge area of the glass pane.

In an advantageous variant, the block piece has a buffer strip made of a material different from that of the block piece for lying against the peripheral side of the glass pane. Such a buffer strip can be made from a material that is especially suitable for lying against the glass pane, e.g., an especially soft, non-slip, and/or sealing material, allowing a wider choice of materials and, if a suitable material is chosen, more slender cross sections for the block piece and consequently also narrower joints between adjacent glass panes. This effectively merges the goals of stability of the fastening apparatus, on the one hand, and, on the other hand, being gentle to the glass.

BRIEF DESCRIPTION OF THE DRAWINGS

The disclosed subject matter is explained in detail below using sample embodiments that are illustrated in the attached drawings. The drawings are as follows.

DETAILED DESCRIPTION

Figure 1:
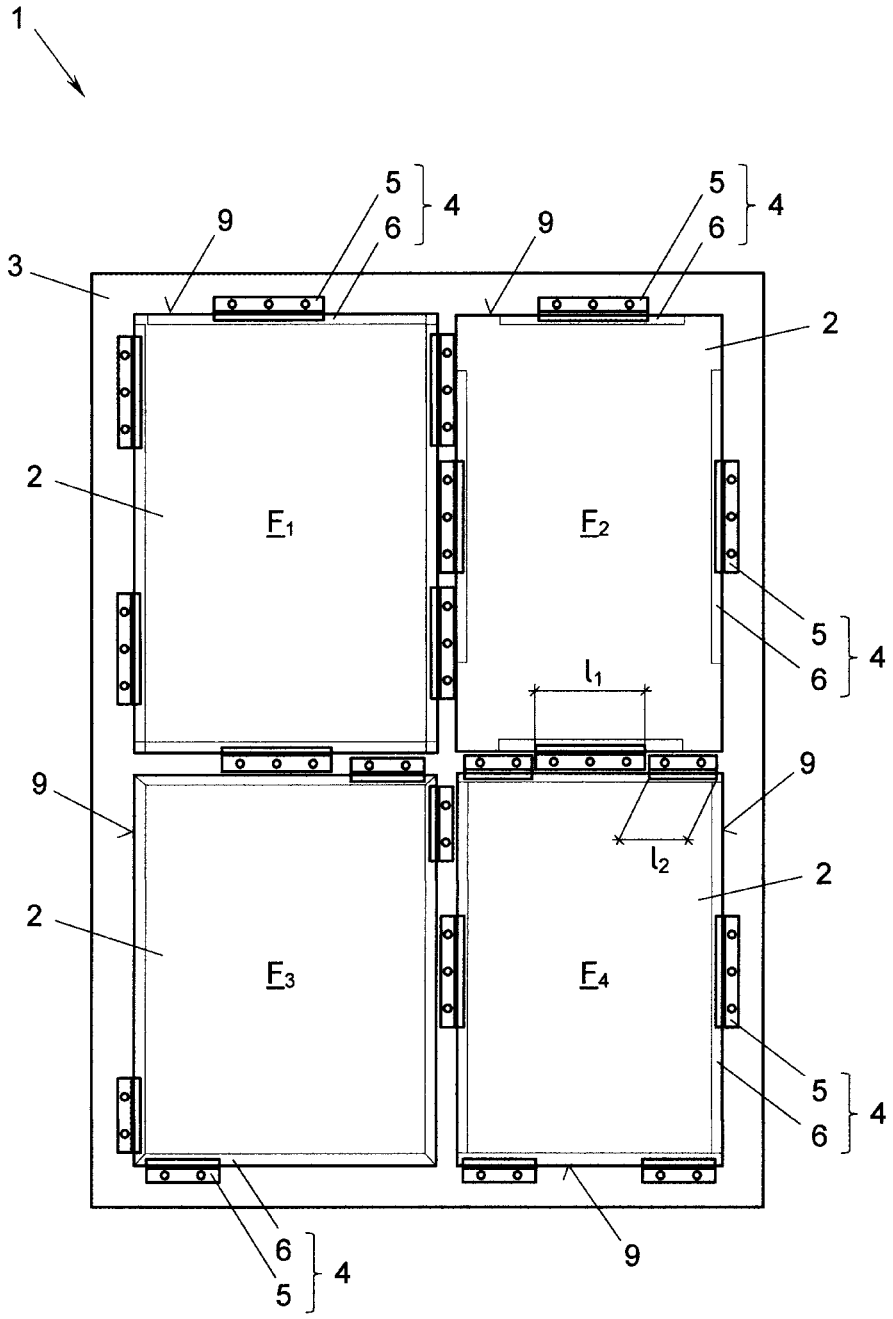
FIG. 1 is a front view of a façade section with four glass panes that are fastened to a substructure with the help of an inventive apparatus.

In the example of FIG. 1, one glass pane 2 is arranged in each of four adjacent fields $F_1$, $F_2$, $F_3$, $F_4$ on a façade section 1. To accomplish this, the four glass panes 2 are detachably fastened, with the help of fastening apparatuses 4, to a substructure 3, e.g., in mullion/transom construction, and this fastening is done so that the substructure 3 comes to lie behind the glass panes 2, all of which are located in a common glass pane plane.

The façade section 1 is, for example, a section of, or one of many modules of a larger building façade, which could also be sloping or arched. Alternatively, the façade section 1 can be a movable element of a façade, e.g., a sliding or casement window, in which case the substructure 3 is mounted so that it is slidable or pivotable. Furthermore, the façade section 1 could be part of a siding in a building interior, e.g., part of an elevator shaft or stairwell siding. Every glass pane 2 can be a single glass pane (FIG. 2*a*) or laminated safety glass pane (FIG. 3*a*), e.g., laminated glass or insulating glass pane, and the substructure 3 can be made of any suitable material, e.g., wood, metal, plastic, or concrete, or of a composite material.

On the basis of the examples of FIG. 2 through 6, the apparatuses 4 used for fastening the glass panes 2 to the substructure 3 in FIG. 1 will be explained in detail below.

Figure 2A:
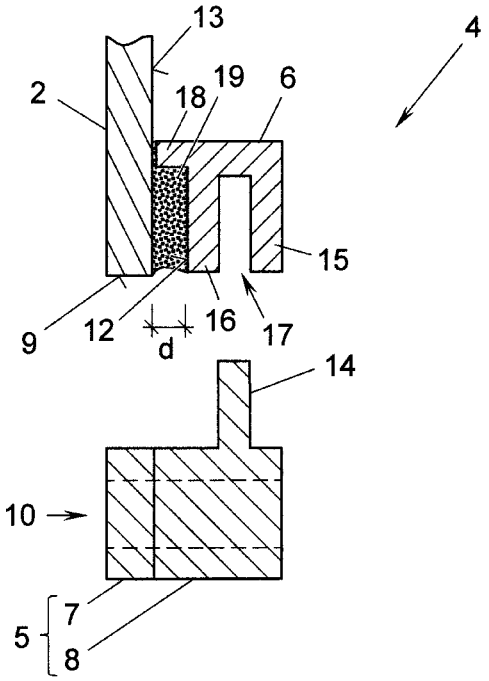
FIGS. 2*a* and 2*b* are, respectively, a cross section of the fastening apparatus of FIG. 1 with a glass pane bonded to it (FIG. 2*a*), and a perspective view, viewed at an angle from above, of a block strip of the apparatus (FIG. 2*b*)

The fastening apparatus 4 basically comprises a block strip 5 and a bonding strip 6 (FIG. 2*a*). In the examples shown, the block strip 5 and the bonding strip 6 are essentially homogeneous profiles in their respective longitudinal directions R (FIG. 2*b*), e.g., they are extruded or continuously cast.

The block strip 5 is subdivided into a block piece 7 and a holding piece 8. The block piece 7 is designed to block the glass pane 2, i.e., to hold the glass pane 2 in the lateral direction on one of its peripheral sides 9. In the direction toward the substructure 3, the holding piece 8 abuts the block piece 7 and, when the glass pane 2 is in the fastened state, the holding piece 8 lies against the substructure 3.

Figure 2B:
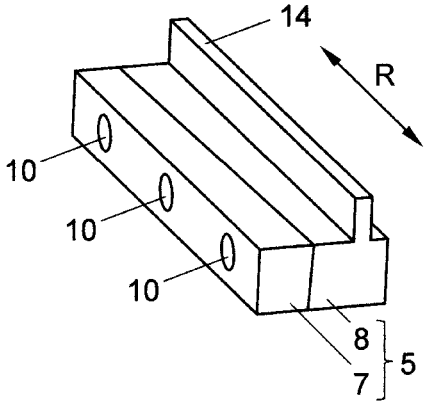

The block strip 5 also has at least one opening 10 to hold fastening means 11, which detachably fasten the block strip 5 to the substructure 3. Possible fastening means 11 are, e.g., fastening bolts or something similar. In the example shown in FIG. 3*a*, the fastening means 11 are a screw, which passes through the block piece 7 and the holding piece 8, and thus the entire block strip 5. As is shown in FIG. 2*b*, multiple such openings 10—in this example three—can pass through the block strip 5.

An outer surface 12 of the bonding strip 6 is bondable to one side 13 of the glass pane 2, namely the side 13 facing the substructure 3 when the glass pane 2 is in the fastened state. The holding piece 8 has a projection 14 and the bonding strip 6 engages the projection 14 on the side facing away from the block piece 7 when the glass pane 2 is in the fastened state. In this way, the bonding strip 6, and thus the entire glass pane 2, is securely held in the direction of the substructure 3, i.e., normal to the plane of the glass pane; the glass pane 2 is simultaneously blocked in the lateral direction by the block strip 5, in particular the block piece 7, without this requiring other mounting means that are visible from outside.

According to the special variant embodiments shown in FIG. 2 through 6, this is accomplished by the bonding strip 6 having, for example, two legs 15, 16 and a groove 17 delimited by them. The projection 14 of the holding piece 8 corresponds with the groove 17 of the bonding strip 6 and engages into the groove 17 when the glass pane 2 is in the fastened state, causing the one leg 15 to reach behind the projection 14 on the side facing away from the block piece 7. The mentioned outer surface 12 of the other leg 16 is bonded to the glass pane 2.

Figure 3A:
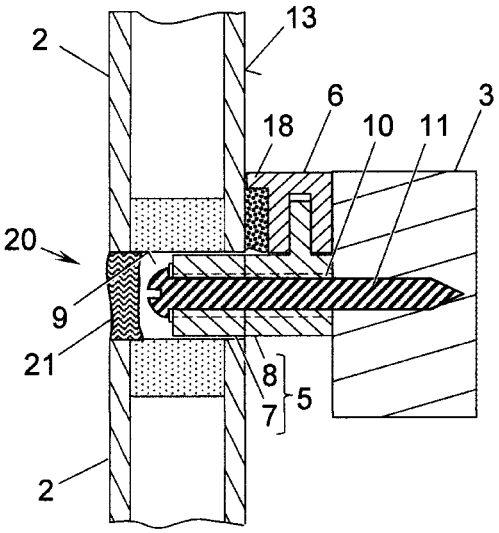
FIGS. 3*a* and 3*b* are cross sections of the fastening apparatus of FIGS. 2*a* and 2*b*, which are being used without (FIG. 3*a*) and with (FIG. 3*b*) a fall prevention device.

The bonding strip 6 can already be bonded to the glass pane 2 at the factory, i.e., before the glass pane 2 is fastened to the substructure 3 and irrespective of the availability of block strips 5. If—as FIG. 3*a* shows as an example—the bonding strip 6 with its two legs 15, 16 is bonded roughly flush with the peripheral side 9 of the glass pane 2, then the latter does not, when it is handled, lie (solely) on the bonding strip 6, so that during transport and storage of a glass pane 2 prefabricated in this way the load is taken off the bonding strip 6.

As can be seen in the example of FIG. 1, the bonding strips 6 can be bonded to the mentioned side 13 along all peripheral sides 9 of the glass pane 2, stopping short at a distance from the corner areas (field $F_2$), or going almost all the way into the respective corner areas (field $F_1$), or going all the way into the corner areas, meeting in, e.g., a miter joint (field $F_3$) or in a butt joint (field $F_4$). Furthermore, block strips 5 can have different lengths $l_1$, $l_2$, . . . and also be differently arranged, e.g., two block strips 5 on each longer peripheral side and only one block strip 5 on each shorter peripheral side 9 (field $F_1$), or vice versa (field $F_4$), or each peripheral side 9 can have one block strip 5, which is arranged in about the middle (field $F_2$), or only in two opposite corner areas (field $F_3$), etc. It is also possible for the block strips 5 used on every glass pane 2 to be made of different materials, e.g., the load-bearing block strips 5 ("supporting blocks") can be made of a more solid material and the block strips 5 that have less load on them ("spacer blocks") can be made of a softer elastic material; individual spacer blocks could even be slightly spaced from the peripheral side 9, at least when the glass pane 2 is cold, as is indicated in the example of FIG. 1 for the block strip 5 in field $F_2$ at the top of the glass pane 2.

The block strip 5 is optionally made in a single piece, e.g., by milling from a block, plastic injection molding, metal die casting, rolling, or extrusion. Depending on the manufacturing process, the block strip can be homogeneous (FIG. 6) or have different materials or strengths over its cross section. Block piece 7 and holding piece 8 can be made, for example, of wood, plastic (with or without fiber reinforcement) or metal; the block piece 7 is generally made of elastic, softer material than the holding piece 8 is, in order not to damage the peripheral side 9 of the glass pane 2 during blocking. Furthermore, the block piece 7 and holding piece 8 can be connected, e.g., bonded, with one another, or can be two separate elements, which can even have different longitudinal dimensions. The projection 14 can also, as is shown in FIG. 2*b*, extend uniformly over the entire length of the block strip 5, or it can be shorter or interrupted, or it can even be formed by individual bolts or pins mounted in the holding piece 8, all of which are subsumed here under the term "projection" 14.

In the variant embodiments of the fastening apparatus 4 shown in FIGS. 2*a*, 3*a*, 3*b*, and 6, the bonding strip 6 also has a shoulder 18. When the bonding strip 6 is bonded to the mentioned side 13 of the glass pane, the shoulder 18 defines a thickness d of the bonding joint 19. The correct bonding joint thickness d ensures stress-free bonding, even if there are changes in the length of the bonding strip 6 and/or glass pane 2 as a consequence, e.g., of temperature effects.

FIG. 3*a* shows a laminated safety glass pane 2 fastened to the substructure 3. In this example, the narrow joint 20 remaining between the fastened glass pane 2 and the glass pane 2 of the adjacent field is closed with joint sealant 21.

Figure 3B:
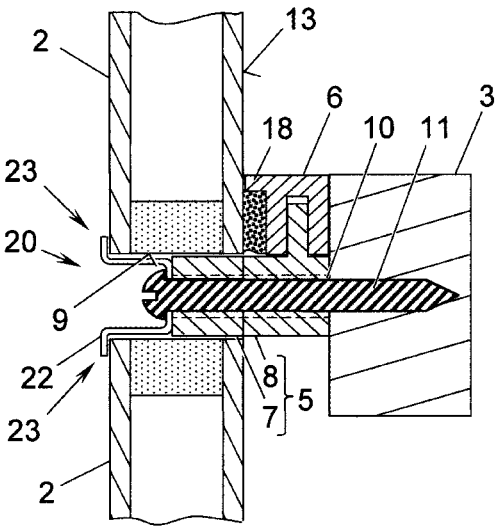

Additionally or alternatively according to FIG. 3*b*, a fall prevention device 22 can be put in the joint 20, e.g., with the fastening means 11, this fall prevention device 22 overlapping the edge area 23 of the glass pane 2 and additionally securing it against falling.

Figure 4:
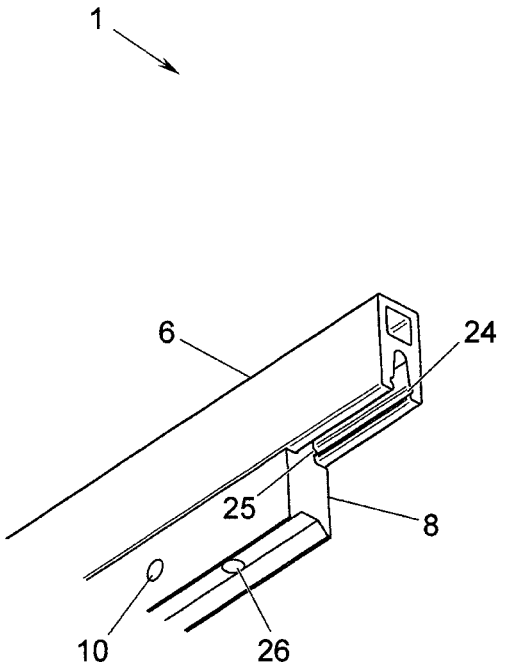
FIG. 4 is a perspective view, viewed at an angle from below, of a detail of another embodiment of the inventive fastening apparatus.
Figure 6:
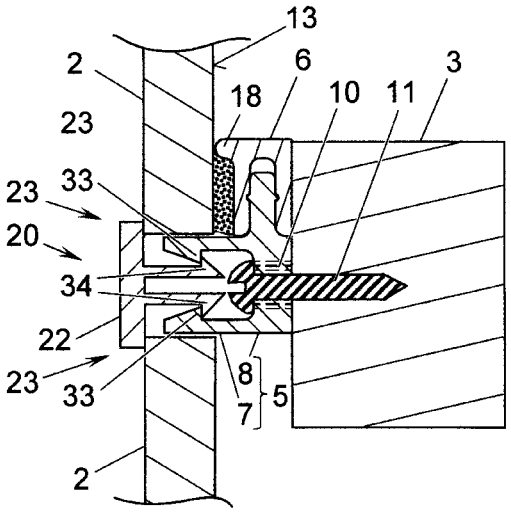
FIG. 6 is a cross section of another variant of the fastening apparatus of FIG. 4 with a fall prevention device.

FIG. 4 through 6 show other embodiments, in which the bonding strip 6 has, in its groove 17 (here on both sides of its groove), an undercut 24, and the holding piece 8 has, on its projection 14 (here on both sides of its projection), a rib 25 that is complementary to this undercut. FIG. 4 shows bonding strip 6 and holding piece 8 without block piece 7. The interaction of undercuts 24 and ribs 25 make the bonding strip 6 and the holding piece 8—or the block strip 5—movable with respect to one another in their longitudinal directions R. It goes without saying that groove 17 and projection 14 can have undercuts 24 and ribs 25, respectively, of diverse shapes with the same effect.

If desired, it is possible to prevent the mentioned movability in the longitudinal direction R, whether or not there are undercuts 24 and ribs 25. To accomplish this, the block strip 5 optionally has at least one further opening 26 passing through it in the direction toward the bonding strip 6. With the help of a retaining pin 27, bolt, or something similar, e.g., a screw, that is inserted into the further opening 26 and that projects into the bonding strip 6, it is possible to lock the block strip 5 with respect to the bonding strip 6. As is represented by dashed lines in FIGS. 5*a* and 5*b*, the projection of the retaining pin 27 into the bonding strip 6 can be facilitated, for example, by having the other opening 26 continue into the bonding strip 6.

Figure 5A:
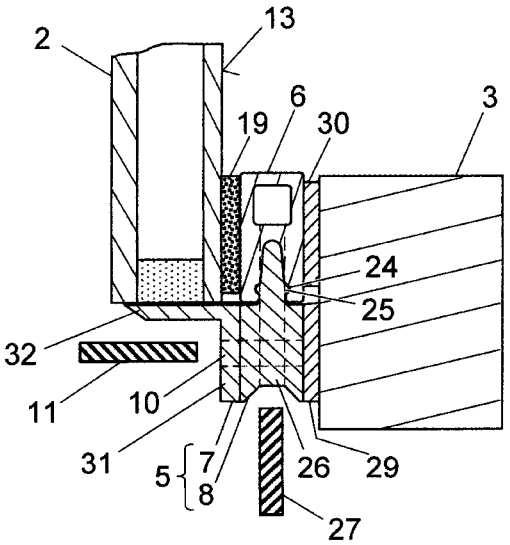
FIGS. 5*a* and 5*b* are cross sections of variants of the fastening apparatus of FIG. 4, which are being used without (FIG. 5*a*) and with (FIG. 5*b*) a buffer strip.
Figure 5B:
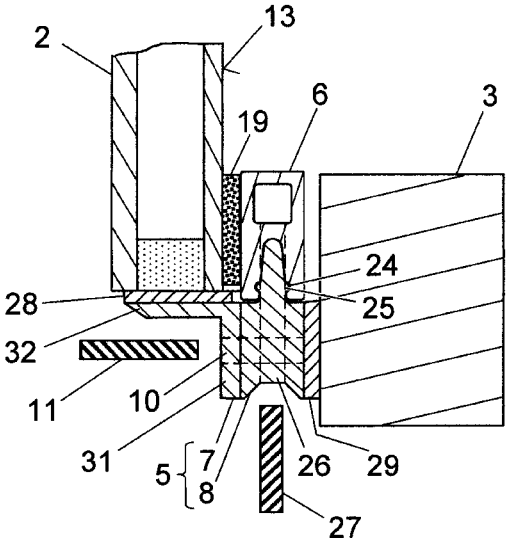

It goes without saying that the cross section of the block piece 7 is not limited to the rectangular shape; for example, in the examples of FIGS. 5*a* and 5*b*, the block piece 7 has an L-shaped cross section, one leg 31 of the L bordering the holding piece 8 and the other leg 32 of the L facing the mentioned peripheral side 9 of the glass pane 2 during blocking. Other cross sectional shapes, e.g., C-shaped, triangular, or similar cross sections, are also possible.

The block piece 7 according to FIG. 5*b* optionally also has a buffer strip 28 made from a material different from that of the block piece 7, e.g., especially a soft material. The buffer strip 28, which lies against the peripheral side 9 of the glass pane 2 during blocking, can be made, for example, of a material that is especially gentle to glass, soft, or that seals especially securely. If desired, the holding piece 8 and/or the bonding strip 6 could also have strips 29, 30 on them that are intended to lie against the substructure 3, these strips 29, 30 being made of a material different from the materials of the holding piece 8 or of the bonding strip 6, as is shown in FIG. 5*a* and FIG. 5*b*.

According to the example of FIG. 6, the fall prevention device 22 can also be latched on at least one latching projection 33, which is optionally formed on the side of the block piece 7 opposite the holding piece 8. In this example, the holding piece 8 has two symmetrical latching projections 33 and the fall prevention device 22 has two symmetrical latching hooks 34 corresponding with them.

The disclosed subject matter is not limited to the presented embodiments, but rather comprises all variants, modifications, and combinations that fall within the scope of the appended claims.

The invention claimed is:

1. An apparatus for detachable fastening of a glass pane to a substructure, comprising:

a block strip that is subdivided into a block piece to block the glass pane on a peripheral side of the glass pane and a holding piece, and a bonding strip, an outer surface of which is bondable to a back side of the glass pane facing the substructure, wherein the holding piece has a projection and the bonding strip engages the projection on a side facing away from the block piece when the glass pane is in a fastened state, wherein at least one opening passes through both the block piece and the holding piece and is configured to receive a fastener for detachable fastening of the block strip to the substructure while the holding piece lies against the substructure.

2. The apparatus according to claim 1, wherein the bonding strip has a groove delimited by two legs, the holding piece projection engaging into the groove when the glass pane is in the fastened state, causing the one leg to engage the projection on said side facing away from the block piece, the other leg being bondable to the glass pane.

3. The apparatus according to claim 2, wherein the groove has at least one undercut and the projection has a rib complementary to this undercut.

4. The apparatus according to claim 1, wherein the block strip is made in a single piece.

5. The apparatus according to claim 1, wherein the block piece and the holding piece are made of different materials.

6. The apparatus according to claim 1, wherein said outer surface of the bonding strip has a shoulder.

7. The apparatus according to claim 1, wherein the block strip has, passing through the block strip in a direction toward the bonding strip, at least one further opening for insertion of a retaining pin, or bolt, projecting into the bonding strip.

8. The apparatus according to claim 1, wherein the block piece has an L-shaped cross section, one leg of the L bordering the holding piece and the other leg of the L facing said peripheral side of the glass pane during blocking.

9. The apparatus according to claim 1, wherein the block piece has, on a side opposite the holding piece, at least one latching projection for latching of a fall prevention device that overlaps an edge area of the glass pane.

10. The apparatus according to claim 1, wherein the block piece has a buffer strip made of a material different from that of the block piece for lying against the peripheral side of the glass pane.

* * * * *